US007013843B1

(12) United States Patent
Weintraub et al.

(10) Patent No.: US 7,013,843 B1
(45) Date of Patent: Mar. 21, 2006

(54) DOWNDRAFT BOILER WITH TURBULATORS

(75) Inventors: George Weintraub, Brooklyn, NY (US); Donald Brown, Sea Cliff, NY (US)

(73) Assignee: Slant/Fin Corporation, Greenvale, NY (US)

( * ) Notice: Subject to any disclaimer, the term of this patent is extended or adjusted under 35 U.S.C. 154(b) by 0 days.

(21) Appl. No.: 11/069,570

(22) Filed: Feb. 28, 2005

(51) Int. Cl.
*F22B 23/06* (2006.01)

(52) U.S. Cl. ..... 122/367.3; 122/248; 122/279

(58) Field of Classification Search ..... 122/367.3, 122/235.17, 235.23, 239, 248, 276, 279, 122/301, 155.2, 155.5, 166.2
See application file for complete search history.

(56) References Cited

U.S. PATENT DOCUMENTS

| | | | | |
|---|---|---|---|---|
| 4,044,796 | A | 8/1977 | Smick | |
| 4,095,087 | A | 6/1978 | Giraud | |
| 4,738,225 | A * | 4/1988 | Juang | 122/367.3 |
| 5,566,648 | A * | 10/1996 | Fenn et al. | 122/367.3 |
| 5,799,622 | A * | 9/1998 | Waldner | 122/387 |
| 6,810,836 | B1 * | 11/2004 | Ferguson et al. | 122/367.3 |

* cited by examiner

*Primary Examiner*—Gregory Wilson
(74) *Attorney, Agent, or Firm*—Herbert Dubno

(57) ABSTRACT

A downdraft boiler has a ceramic burner plate overlying a horizontal-tube heat exchanger at least the upper tubes of which each have an internal turbulator preventing premature vaporization of the water traversing the heat exchanger. The turbulator can consist of a twisted metal strip whose edges lie along helices.

12 Claims, 7 Drawing Sheets

DOWNDRAFT BOILER WITH TURBULATORS

FIELD OF THE INVENTION

The present invention relates to a downdraft boiler and, more particularly, a downdraft boiler with tubulators.

BACKGROUND OF THE INVENTION

Normally the burner in a boiler is provided below the heat exchanger so that the flow of flue gases is upwardly through the heat exchanger to the flue of the boiler.

Downdraft boilers are, of course, also known in which the burner may be at the top of the boilers and the flue gases are conducted downwardly through the heat exchanger and then pass from the heat exchanger chamber to the flue of the boiler.

An important advantage of a downdraft boiler is that it can be significantly more compact than a boiler in which the flue gases flow upwardly through the heat exchanger.

However, a major problem with downdraft boilers, especially in a compact configuration, is that the burner may be directly juxtaposed with the uppermost tubes of the heat exchanger, thereby causing overheating of the water in those tubes, inappropriate boiling so that gas formation may impede the flow of water through the tubes, and encrustation of these tubes with deposits from the water which passes through the tubes.

OBJECTS OF THE INVENTION

It is, therefore, the principal object of the present invention to provide an improved downdraft boiler whereby the aforementioned drawbacks are avoided.

More specifically, it is an object of this invention to provide a downdraft boiler in which overheating of at least the uppermost heat exchanger tubes can be avoided. A corollary object of the invention is to prevent, in a downdraft boiler, the undesired vaporization of water.

A further object of this invention is to provide an improved heat exchanger assembly, e.g. for use in a hot water generating unit.

SUMMARY OF THE INVENTION

These objects and others which will become apparent hereinafter are attained, in accordance with the invention, in a downdraft boiler for producing heated water for space heating purposes primarily and which comprises:

- a boiler housing formed with a combustion chamber at a top of the housing and a heat exchanger chamber below the combustion chamber;
- a burner on the housing at the top thereof for combustion of a fuel to produce a flue gas in the combustion chamber;
- a heat exchanger in the heat exchanger chamber below the burner comprising a plurality of horizontal heat exchanger tubes traversable by water and heated by a downflow of the flue gas around the tubes;
- a twisted baffle in at least uppermost tubes of the heat exchanger for limiting overheating of water therein; and
- a flue gas outlet on the housing communicating with the heat exchanger chamber below the heat exchanger.

The burner can be a horizontal flat ceramic burner juxtaposed with the heat exchanger, the heat exchanger having an upper layer of the tubes, each provided with a respective such twisted baffle.

The tubes can be so-called finned tubes, i.e. tubes which are provided with heat exchanger fins or tubes which are formed by closely spaced fins having formations interfitting with one another. In any event the heat exchanger itself is provided with closely spaced vertical fins connected to the tubes.

Each of the fins can be traversed by a number of tubes and there can be an upper array of such fins which have a greater separation above the lower array of fins, the upper array being for example traversed by two horizontal rows of tubes while the lower array is traversed by only one row of tubes.

The heat exchanger assembly itself, for use in such a boiler or independently, i.e. for other heat exchanger purposes, can form a unit consisting of the fins and tubes and a pair of plates at opposite ends through which the tubes emerge and where the tubes can be interconnected by elbows and/or tees to permit water flow from an inlet fitting to an outlet fitting.

While it has been found to be advantageous to have a twisted baffle in each of the uppermost tubes of the heat exchanger or the row of tubes closest to the heating source, it has also been discovered that the twisted baffles greatly improve the overall effectiveness of the heat exchanger and thus that each such tube of the heat exchanger should be provided with a respective twisted baffle. The twisted baffle can be sheet metal strips having a helical twist whereby edges of said strips lie along respective helices.

Internal baffles within a heat exchanger tube are of course known and reference may be made to the turbulator of U.S. Pat. No. 4,044,796.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
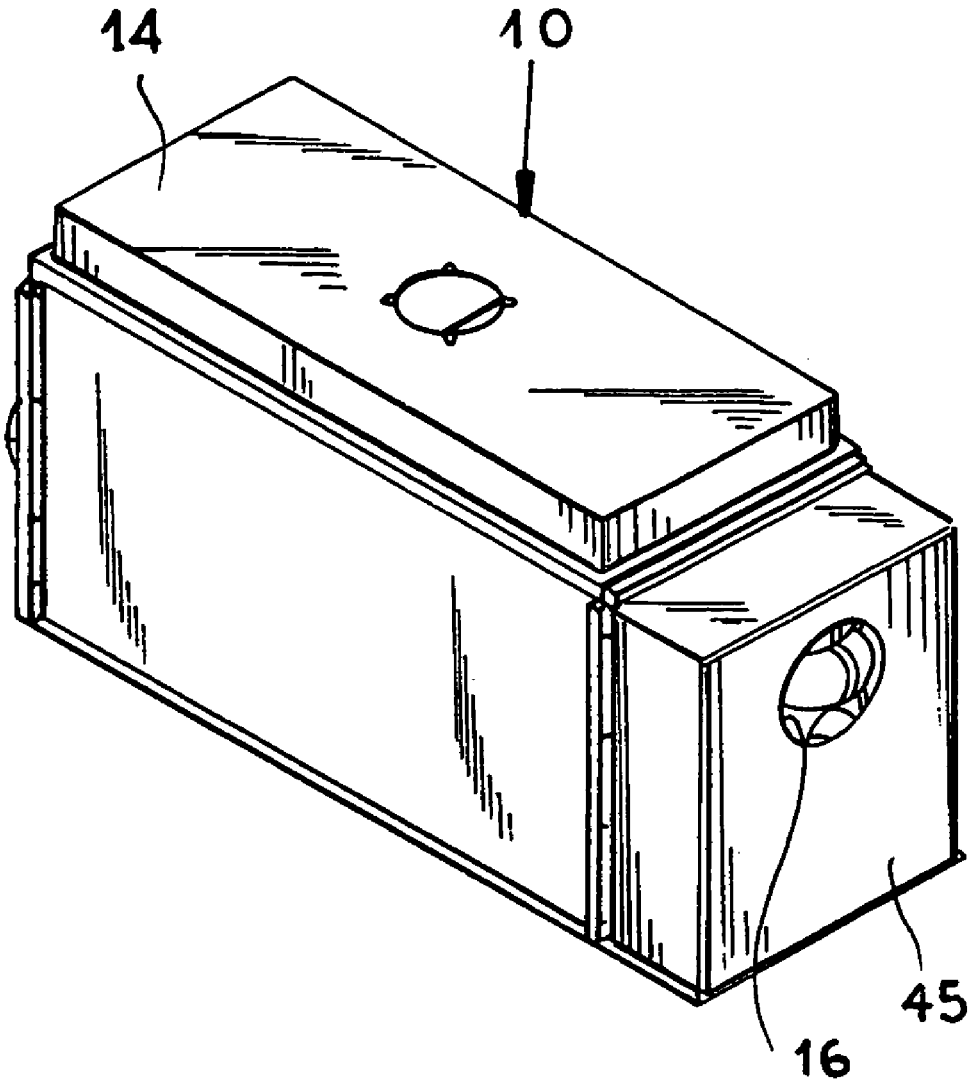
FIG. 1 is a perspective view from the top and rear of a downdraft boiler in accordance with the invention in diagrammatic form.
Figure 2:
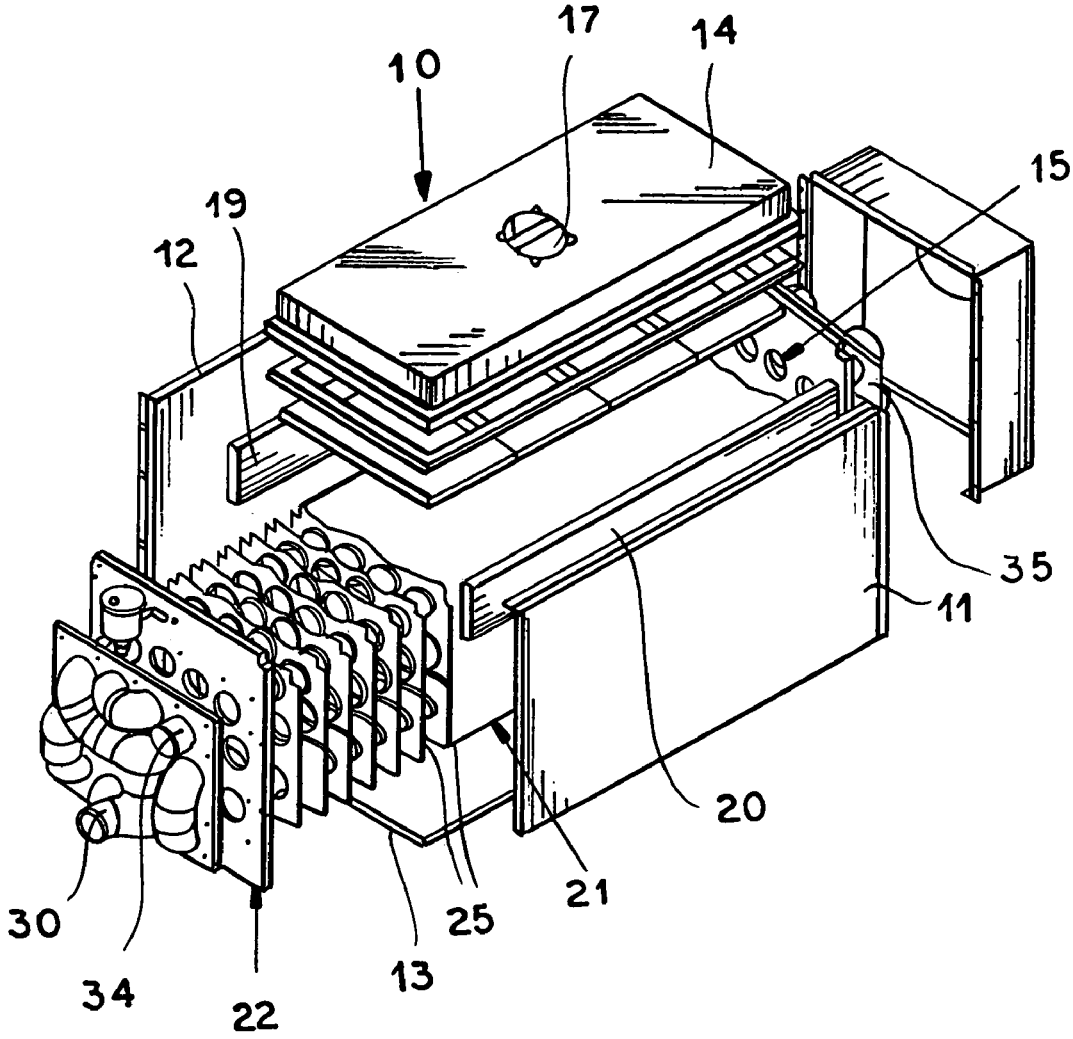
FIG. 2 is a somewhat exploded perspective view showing the main parts of that boiler.

From FIGS. 1 and 2, it can be seen that the boiler 10 comprises a boiler housing having a pair of sidewalls 11, 12, a bottom wall 13, a top shell 14 and a rear shell 45, the latter having an opening 16 which can be connected to a flue pipe.

Figure 7:
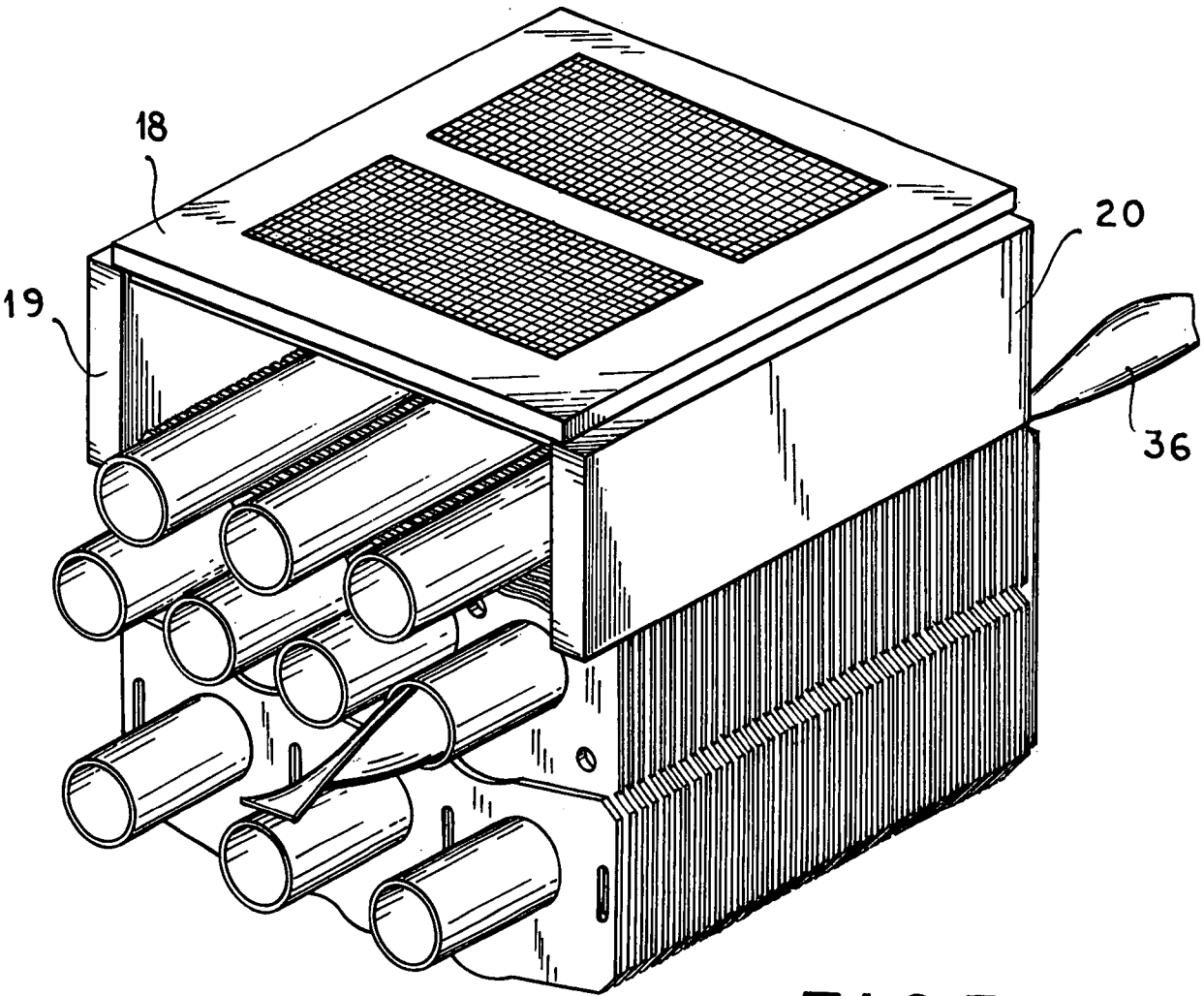
FIG. 7 is a diagram representing a perspective view of the heat exchanger assembly and its relationship to the heating source with one embodiment of a turbulator illustrated therein.

Within the housing (FIG. 4), below the shell 14, a combustion chamber 15 is formed in the housing and is bounded at the top by a ceramic burner representing only diagrammatically at 16 to which air can pass through an opening 17 in the shell 14. The lower part of the burner is formed by a perforated plate represented at 18 in FIG. 7 and the combustion chamber can be flanked by refractory plates 19 and 20.

Below the combustion chamber 15, the boiler is formed with a heat exchanger chamber 21 receiving a heat exchanger assembly 22 which is traversed by water.

The heat exchanger assembly itself comprises an array of upper fins 23 traversed by a row of upper tubes 24 and less closely spaced than the lower fins 25 of another fin array. In the embodiment illustrated (see especially FIG. 6) there are four uppermost tubes 24 traversing the fins 23 along with a row of four intermediate tubes 26 while the tubes (four in number) 27 traversing the fins of the lower array represent the lowermost tubes in the heat exchanger.

Figure 3:
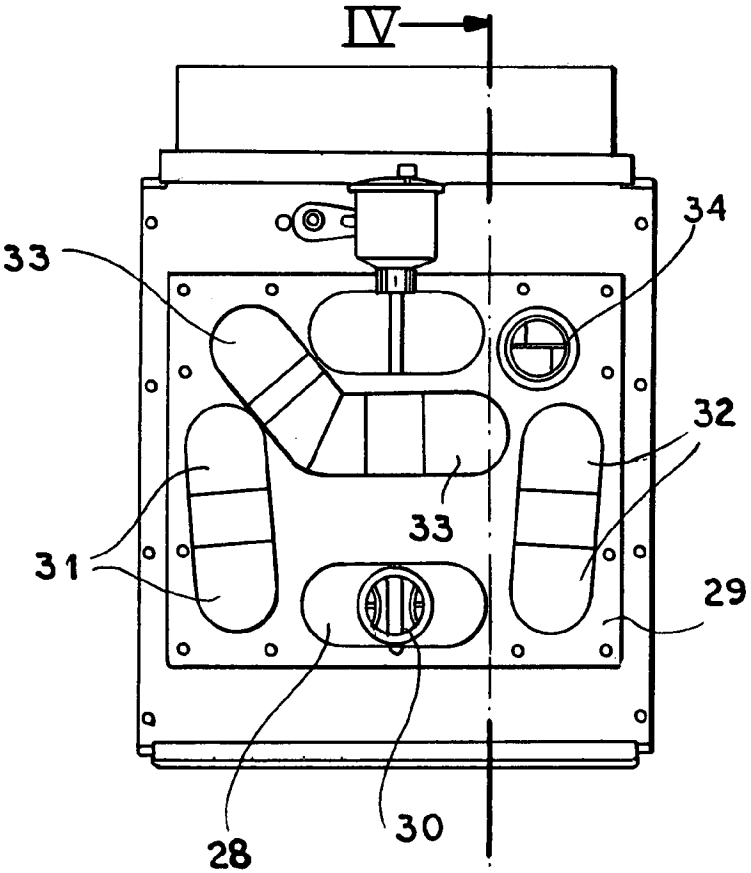
FIG. 3 is an end view of the boiler from the front with the front cover, if any, removed.

As will be apparent from FIGS. 2 and 3, a Tee 28 is connected to two of the lower most tubes outside of a terminal plate 29 of the heat exchanger assembly and is formed with the water inlet fitting 30. Elbows at the opposite end of the array connect these tubes to the other tubes 27 of the lower array whereas elbows 31 and 32 connect the tubes of the lower array is to the outermost tubes of the intermediate row 26 and elbows on the opposite side connect these tubes to the inner tubes 26 which, in turning, are connected by elbows 33 with the upper tubes 24. The water outlet fitting is represented at 34 in FIGS. 2 and 3.

The terminal plate at the opposite end of the heat exchange assembly has been represented at 35.

Figure 6:
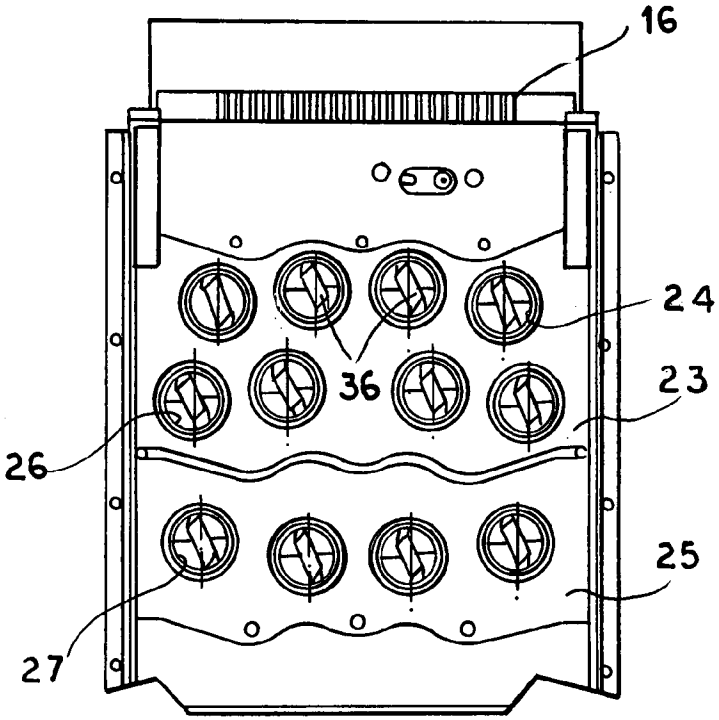
FIG. 6 is a cross sectional view taken along the line VI—VI of FIG. 5.
Figure 4:
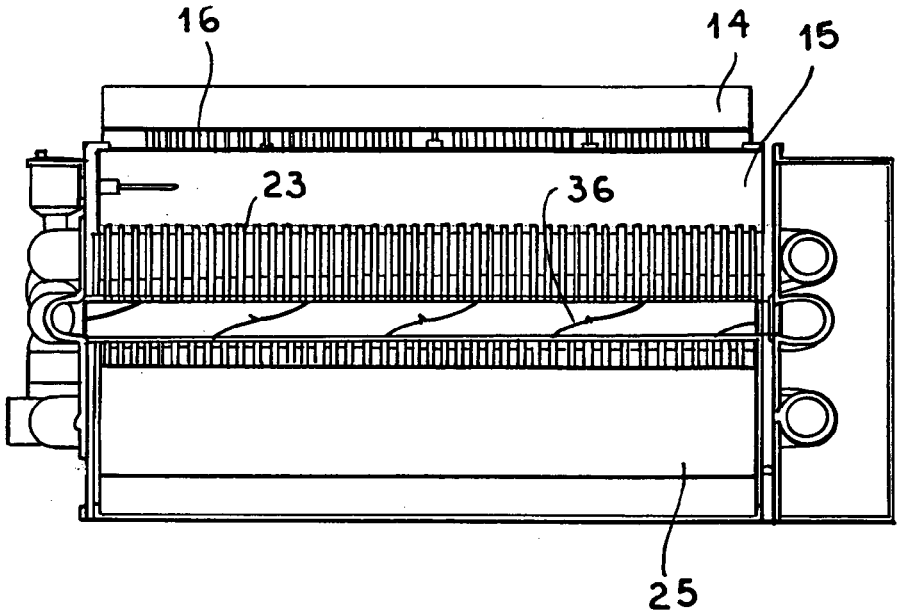
FIG. 4 is a cross section taken along the line IV—IV of FIG. 3.
Figure 5:
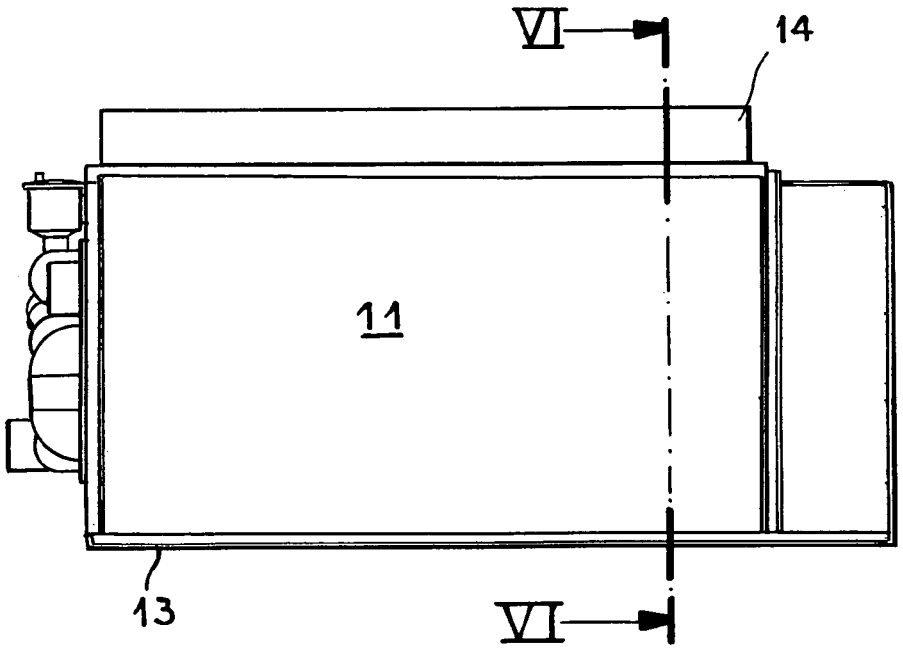
FIG. 5 is a side view of the boiler.

As can be seen at 36 in FIG. 4 and in FIG. 6, each of the tubes and thus at least the tube of the upper row contain twisted baffles extending the full length of the tubes within the heat exchanger chamber which prevent overheating of the water at least with respect to the tubes closest to the heating source. As noted, those baffles improve heat exchange for all of the tubes.

Figure 9:
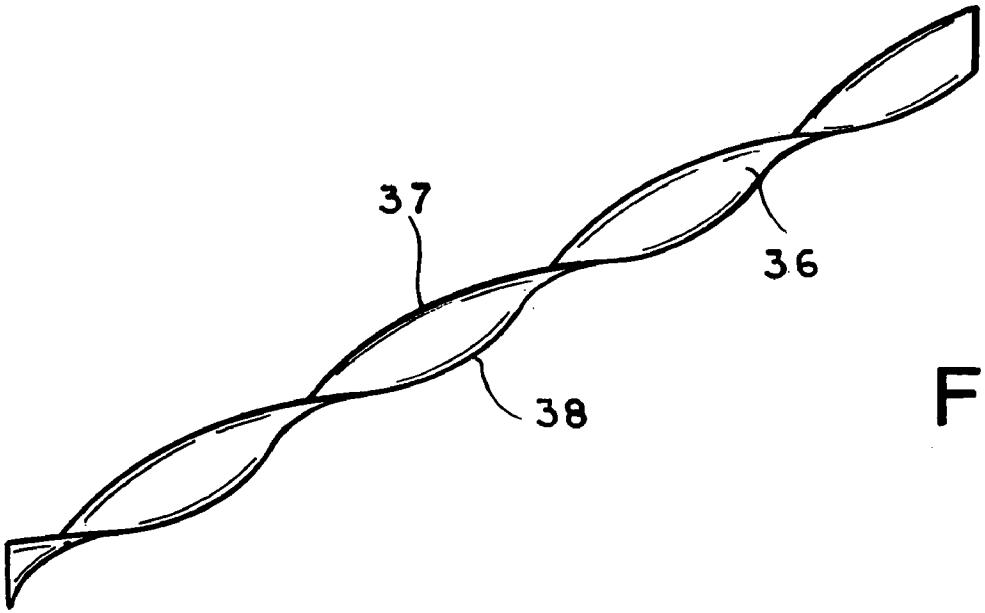
FIG. 9 is a perspective view thereof.
Figure 8:
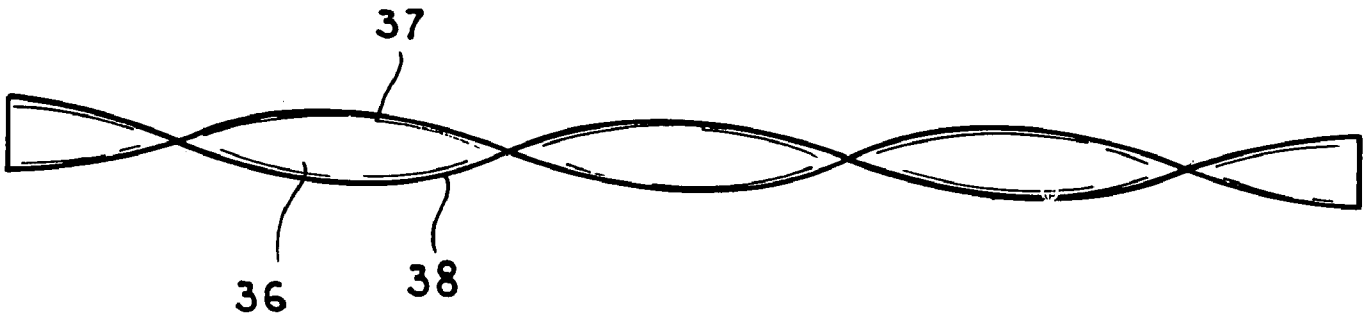
FIG. 8 is a side elevational view of the turbulator.

The twisted baffle or turbulator 36 (see FIGS. 7, 8 and 9) can be fixed in the tube by welding or soldering or can simply be free in the tube, can frictionally engage the walls of the tubes or can be largely free from frictional engagement and thus capable of rotation or movement, and can generally have edges 37 and 38 which describe helices within the tubes.

Figure 10:
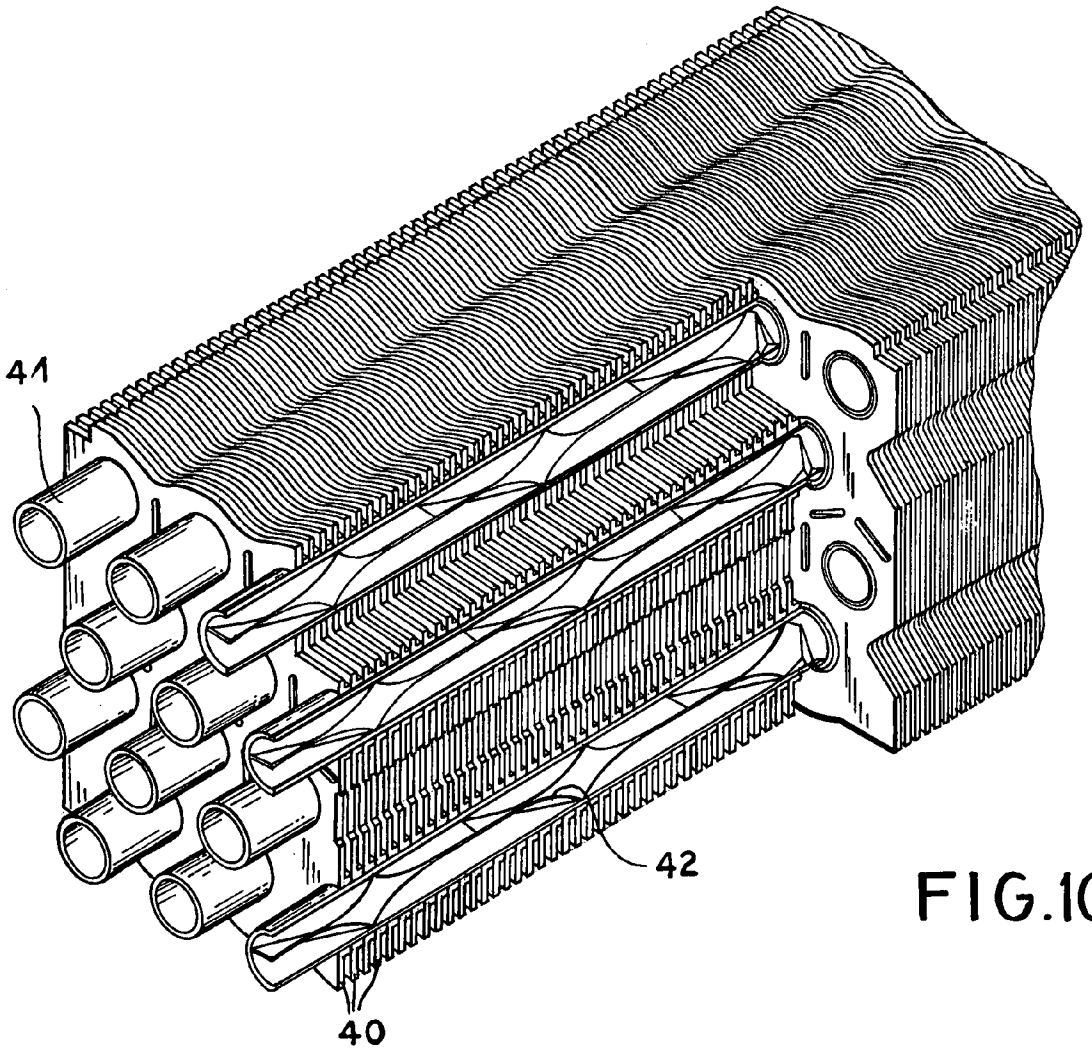
FIG. 10 is a diagram of another heat exchanger assembly with a slightly different configuration of the turbulator.

In FIG. 10, fins 40 have been shown to be traversed by tubes 41, each of which can have a baffle 42 therein which provides an irregular twist or a series of partial twists which do not have a spiral or helical pattern.

In operation, while the water to be heated is circulated through the heat exchanger assembly, the flue gases produced by the ceramic burner pass downwardly between the fins, heating the water in the tubes. Undesired vaporization of the water is prevented by the turbulators of at least the upper row of tubes.

The invention claimed is:

1. A downdraft boiler comprising:

a boiler housing formed with a combustion chamber at a top of said housing and a heat exchanger chamber below said combustion chamber;

a burner on said housing at the top thereof for combustion of a fuel to produce a flue gas in said combustion chamber;

a heat exchanger in said heat exchanger chamber below said burner comprising a plurality of horizontal heat exchanger tubes traversable by water and heated by a downflow of said flue gas around said tubes;

a twisted baffle in at least uppermost tubes of said heat exchanger for limiting overheating of water therein; and a flue gas outlet on said housing communicating with said heat exchanger chamber below said heat exchanger.

2. The downdraft boiler defined in claim 1 wherein said burner is a horizontal flat ceramic burner juxtaposed with said heat exchanger, said heat exchanger having an upper layer of tubes each provided with a respective twisted baffle.

3. The downdraft boiler defined in claim 2 wherein said heat exchanger is provided with closely spaced parallel vertical fins connected to said tubes.

4. The downdraft boiler defined in claim 3 wherein each of said fins is traversed by a plurality of said pipes.

5. The downdraft boiler defined in claim 4 wherein an upper array of said fins is traversed by least one row of upper tubes and a lower array of fins is traversed by at least one row of tubes, said fins of said lower array having a closer spacing than the fins of said upper array.

6. The downdraft boiler defined in claim 5 wherein said upper array of fins is traversed by two horizontal rows of four tubes each and said lower array of fins is traversed by one horizontal row of four tubes.

7. The downdraft boiler defined in claim 4 wherein all of said tubes are provided with said twisted baffles.

8. The downdraft boiler defined in claim 4 wherein said twisted baffles are sheet metal strips having a helical twist whereby edges of said strips lie along respective helices.

9. The downdraft boiler defined in claim 8 wherein said strips are fixed in said tubes.

10. The downdraft boiler defined in claim 4 wherein said heat exchanger has a generally square vertical cross section and said housing the configuration generally of a rectangular parallelepiped.

11. A heat exchanger assembly for water heating comprising a plurality of heat exchanger tubes traversable by water and at least one array of fins through which said tubes extend, and a respective twisted baffle in each of said tubes, an upper array of said fins being traversed by at least one row of upper tubes and a lower array of said fins being traversed by at least one lower row of said tubes.

12. The heat exchanger assembly defined in claim 11 wherein said twisted baffles are sheet metal strips having a helical twist whereby edges of said strips lie along helices.

* * * * *